United States Patent [19]

Magrath

[11] Patent Number: 4,596,572

[45] Date of Patent: Jun. 24, 1986

[54] DEVICE FOR TRANSFERING LIQUIDS

[76] Inventor: Joseph M. Magrath, P.O. Box 148, McCook, Nebr. 69001

[21] Appl. No.: 702,648

[22] Filed: Feb. 19, 1985

Related U.S. Application Data

[63] Continuation of Ser. No. 539,536, Oct. 5, 1983, abandoned.

[51] Int. Cl.[4] ..... A61J 1/00

[52] U.S. Cl. ..... 604/413; 222/80; 141/329

[58] Field of Search ..... 604/413, 411; 141/19, 141/285, 309, 319, 329, 330; 222/80, 85

[56] References Cited

U.S. PATENT DOCUMENTS

| | | | |
|---|---|---|---|
| 1,718,593 | 6/1929 | Smith | 604/413 |
| 2,410,991 | 11/1946 | Muller | 604/413 |
| 2,715,402 | 8/1955 | Wooton | 604/411 |
| 2,893,389 | 5/1959 | Nesset | 604/412 |
| 3,484,849 | 12/1969 | Huebner | 604/413 X |
| 4,203,443 | 5/1980 | Genese | 604/413 |

*Primary Examiner*—Stephen C. Pellegrino
*Attorney, Agent, or Firm*—Wm. Griffith Edwards

[57] ABSTRACT

A device for transferring a liquid from a bottle at substantially atmospheric pressure to a bottle at a low pressure comprises a hollow needle of steel or the like mounted in a grip or handle member having a configuration to facilitate the pushing of the needle through a bottle stopper at either end of the device. The needle is sharply pointed at both ends and the handle consists of a strip of steel or other suitable metal bent at its ends to provide stops having holes to accommodate the needle which extends beyond the stop at each end. The strip is bent or bowed toward the center portion of the needle and is soldered or otherwise secured to the needle. The sloping portions of the strip provide thumb rests for pushing the needle in either direction.

2 Claims, 4 Drawing Figures

DEVICE FOR TRANSFERING LIQUIDS

This application is a continuation of application Ser. No. 539,536, filed Oct. 5, 1983, now abandoned.

This invention relates to the transfer of fluid from one stoppered container to another and, particularly to an improved device for transferring a liquid in one bottle to another bottle at lower pressure and containing a substance to be mixed with the liquid.

Various drugs and biologicals are administered in liquid form by hypodermic injection either intramuscularly, subcutaneously or intravenously. Such drugs may comprise an active component and a liquid carrier and may be sold in kits containing stoppered and sealed bottles or similar containers, one containing the liquid at about atmospheric pressure and the other containing the active ingredient in a vacuum-dried form, the bottle containing a vacuum which is maintained by the bottle stopper and seal. A transfer needle is provided with the kit and is sealed in a sterile container. The transfer of the liquid is effected by inserting one end of the transfer needle through the liquid bottle stopper into communication with the bottle interior. The other end of the needle is then inserted through the stopper of the second bottle, whereupon the liquid flows into the second bottle releasing the vacuum and mixing the two components of the medicine. The needle is then withdrawn leaving the bottle sealed. The drug may then be removed in the usual manner by operation of the hypodermic syringe to be used for administering the drug.

The transfer needle provided with such kits is commonly a short, straight, hollow needle pointed at both ends and having a small, solid metal cylinder at its center which may be gripped between the thumb and forefinger. The length of the needle is such that each pointed end may pierce the bottle stopper and open into the interior of the bottle.

While the present transfer needles have proved satisfactory for their intended purpose, they may be difficult for some to handle and must be handled carefully to avoid contact with the exposed point when inserting the needle in the first bottle. Accordingly, it is an object of the present invention to provide an improved fluid transfer needle for quick and effective insertion in the stoppers of sealed bottles or the like.

It is another object of this invention to provide an improved fluid transfer needle which is easy to manipulate and safer to use.

SUMMARY OF THE INVENTION

Briefly, in carrying out the objects of this invention in one embodiment thereof, a length of hollow steel needle which is pointed at both ends is provided with a handle or gripping member which comprises a strip of steel or other resilient metal which has its ends bent transversely of its axis to provide end pieces or stops. Round holes in the end pieces are provided to fit closely about the needle. The metal strip is bowed intermediate its ends; and when the needle is in place in the holes, the central part of the bowed portion is attached to the needle. The ends of the needle project beyond the end pieces a distance sufficient to pierce the stopper of a sealed bottle and reach the inside. The bowed portion provides a grip which increases in thickness toward the ends and is effective for applying longitudinal force in either direction for piercing a bottle seal. This facilitates and speeds the piercing operation.

The features of novelty which characterize the invention are set forth in the appended claims. The invention will be best understood upon reference to the following description taken in connection with the accompanying drawing.

DETAILED DESCRIPTION OF THE PREFERRED EMBODIMENT

Figure 1:
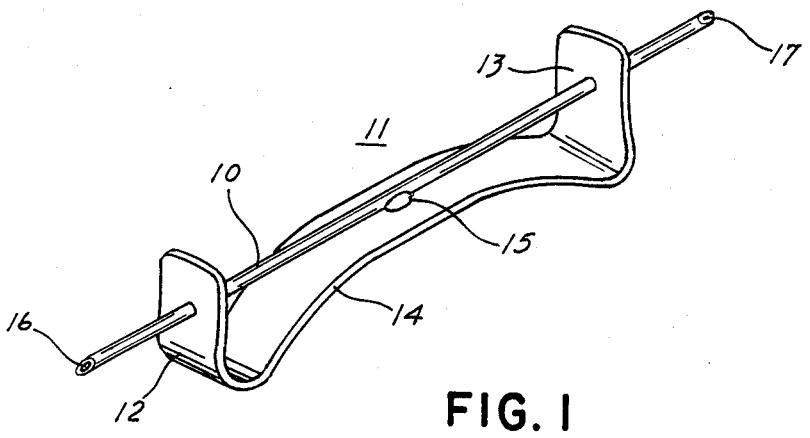
FIG. 1 is a perspective view of a transfer needle device embodying the invention.
Figure 2:
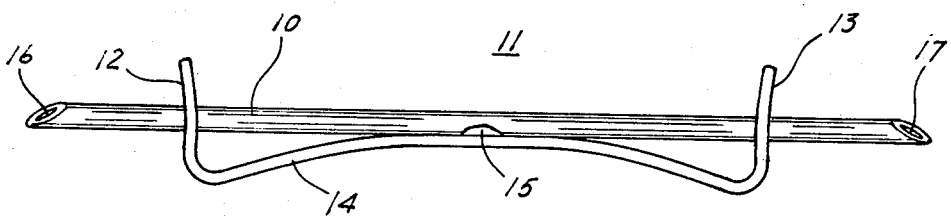
FIG. 2 is a side elevation view of the device of FIG. 1.
Figure 3:
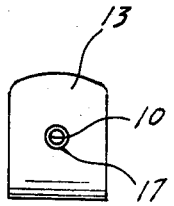
FIG. 3 is an end elevation view of the device of FIG. 2.
Figure 4:
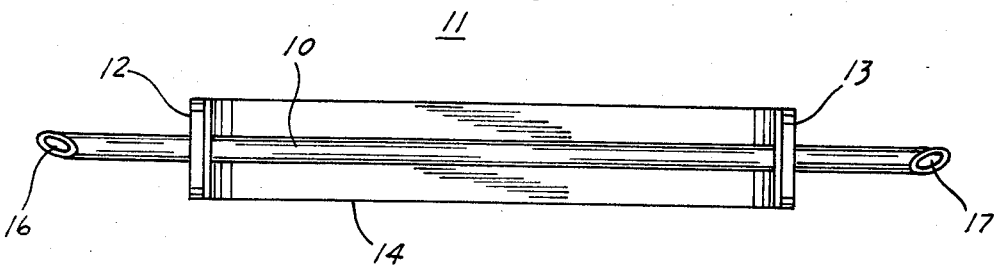
FIG. 4 is a top plan view of the device.

Referring now to the drawing, the liquid transfer needle device of this invention as illustrated in FIG. 1 comprises a straight, hollow steel needle 10 fitted in a holder 11 which is in the form of a metal strip bent upwardly at its ends to provide end pieces or stops 12 and 13 which extend substantially normal to the needle as shown in FIG. 2. The body of the strip, as indicated at 14, is bowed toward the needle. The strip may be of cold rolled steel or any other suitable metal.

Holes are provided in the ends 12 and 13 and are of a size to fit closely about the needle. When the needle is in place with both ends extending the same distance from the stops 12 and 13, the strip and the needle are suitably secured together at their central portion; preferably the securing means is solder as indicated at 15 in FIG. 2. This prevents relative movement of the strip and the needle when the needle is being forced through a bottle stopper.

The end portions of the needle which extend beyond the end stops 12 and 13 are of a length sufficient to pass through the bottle stoppers and to open into the interior.

The ends of the needle are sharpened as indicated at 16 and 17 in FIG. 2, the point being of the type designed to minimize coring of the stopper material. For some applications, it may be preferably to provide a needle point of the closed, somewhat conical, end type wherein a hole or holes are provided in the sloping sides; this type of needle point compresses the material around the hole made in the stopper and the openings are in position to clear the stopper and afford communication between the needle bore and the interior of the bottle or other container.

The transfer device of this invention is made somewhat larger than the conventional device. By way of example, the needle may be three (3) inches long and the distance between the bent ends of the handle strip may be two (2) inches and the portion of the needle extending beyond the strip may be one-half (½) inch long.

When the device is ready for use, the liquid-containing bottle is held in one hand and the device is held in the other. The strip 14 is gripped between the user's thumb and forefinger with the thumb pointing toward the end of the needle which is to be inserted through the stopper. In this position, the thumb presses longitudinally against the outwardly sloping portion of the strip toward the end to be pushed through the stopper. The needle is then pressed forward through the bottle stopper until the end 12, say, rests against the stopper or bottle top. The bottle is thus attached to the device, which is then gripped by the thumb and forefinger near the other end of the strip. The other end of the needle is then pressed through the stopper of the vacuum bottle, the bottle being held with the liquid bottle above the other. When the needle pierces the vacuum bottle stopper and enters that bottle, the difference in pressure forces the liquid to flow into the vacuum and the drug therein is mixed with the liquid. The needle is withdrawn when the liquid has been transferred and the needle is removed, the stopper resealing behind it. The prepared liquid medicine is then ready for removal by a hypodermic syringe for injection into the patient.

The configuration of the strip provides a positive gripping surface for holding the transfer device in position during the application of pressure to the needle when it is being inserted through a stopper. The strip handle is light in weight and provides a positive grip for manipulating the needle during preparation of the dose of medicine to be injected. The arrangement of the strip also provides a better indication to the user as to the direction of the needle points and serves to decrease accidental engagement with a needle point.

I claim:

1. As an article of manufacture, a fluid transfer needle device for effecting a transfer of fluid at a predetermined pressure from a first closed bottle having a pierceable stopper and a lower internal pressure comprising a hollow needle having sharp, pointed ends and an elongated handle on said needle intermediate said ends with a portion of said needle extending from each end of said handle a distance sufficient to pass through respective ones of said stoppers, the outer surface of said handle being close to said needle in its mid-section and having end portions extending transversely of the needle a substantial distance, the surface of said handle sloping gradually from each end toward its mid-section and means for preventing relative movement of said needle and said handle, and wherein said handle is a metal strip having its end bent to form said end portions substantially normal to said needle with said mid-portion bent inwardly toward and engaging the central portion of said needle, said end portions having holes and said needle passing through said holes and being secured to said central portion of said handle by said means.

2. As an article of manufacture, a fluid transfer needle comprising a hollow metal needle having sharp ends for piercing bottle seals and the like and an elongated handle for said needle comprising a flat metal strip formed with ends bent laterally and having holes to receive said needle, said strip between said bent ends being bowed inwardly toward the line between said holes, said needle extending longitudinally of said strip and being positioned in said holes with end portions extending a substantial distance beyond said bent ends of said strip, and means for securing the bowed portion of said strip to said needle centrally of the strip.

* * * * *